US011440207B2

(12) United States Patent
Grasmeijer et al.

(10) Patent No.: US 11,440,207 B2
(45) Date of Patent: Sep. 13, 2022

(54) HAIR-CUTTING UNIT WITH CUTTER BLOCKING PREVENTION

(71) Applicant: KONINKLIJKE PHILIPS N.V., Eindhoven (NL)

(72) Inventors: Ingmar Grasmeijer, Leeuwarden (NL); Margarita Zwanette Van Raalte, Tuk (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 17/056,025

(22) PCT Filed: Nov. 20, 2019

(86) PCT No.: PCT/EP2019/081861
§ 371 (c)(1),
(2) Date: Nov. 17, 2020

(87) PCT Pub. No.: WO2020/109094
PCT Pub. Date: Jun. 4, 2020

(65) Prior Publication Data

US 2021/0308884 A1 Oct. 7, 2021

(30) Foreign Application Priority Data

Nov. 28, 2018 (EP) ..... 18208986

(51) Int. Cl.
*B26B 19/14* (2006.01)
*B26B 19/38* (2006.01)

(52) U.S. Cl.
CPC ..... *B26B 19/14* (2013.01); *B26B 19/141* (2013.01); *B26B 19/143* (2013.01); *B26B 19/3846* (2013.01)

(58) Field of Classification Search
CPC ..... B26B 19/14–148; B26B 19/3846
(Continued)

(56) References Cited

U.S. PATENT DOCUMENTS 2,877,548 A * 3/1959 Starre ..... B26B 19/384 30/43.6
3,962,784 A * 6/1976 Tietjens ..... B26B 19/145 30/43.6
(Continued)

FOREIGN PATENT DOCUMENTS

DE 2342678 3/1974
EP 0428211 5/1991
(Continued)

OTHER PUBLICATIONS

International Search Report and Written Opinion dated Feb. 19, 2020 for International Application No. PCT/EP2019/081861 Filed Nov. 20, 2019.

*Primary Examiner* — Jason Daniel Prone

(57) ABSTRACT

A rotary hair-cutting unit including an internal cutting member having cutting elements with cutting edges, and an external cutting member having hair-guiding elements with counter-cutting edges). The co-operating edges define a shearing angle, such that during rotation a cutting edge first meets a counter-cutting edge at a radial initial-passing position. In a cross-section at said radial initial-passing position one of the internal cutting member and the external cutting member is provided with a particular abutment geometry. The inclusion of an abutment geometry will be effective to push the depressed hair-guiding element and the rotating cutting element axially away from one another, such that the cutting element will pass the hair-guiding element without being blocked and without causing substantial collision damage.

9 Claims, 8 Drawing Sheets

(58) Field of Classification Search
USPC ..... 30/43.4–43.6
See application file for complete search history.

(56) References Cited

U.S. PATENT DOCUMENTS

| | | | | | |
|---|---|---|---|---|---|
| 4,192,065 | A * | 3/1980 | Tietjens | B26B 19/14 | 30/43.6 |
| 4,343,089 | A * | 8/1982 | Suzuki | B26B 19/384 | 30/43 |
| 4,998,352 | A | 3/1991 | Tietjens | | |
| 5,408,749 | A | 4/1995 | Momose | | |
| 6,085,421 | A * | 7/2000 | Jorna | B26B 19/143 | 30/43.6 |
| 6,968,620 | B2 * | 11/2005 | Okabe | B26B 19/14 | 30/43.6 |
| 7,003,886 | B2 * | 2/2006 | Okabe | B26B 19/141 | 30/346.51 |
| 7,065,878 | B2 * | 6/2006 | Uchiyama | B26B 19/141 | 30/43.6 |
| 7,356,929 | B2 * | 4/2008 | Nakano | B26B 19/141 | 30/43.6 |
| 7,743,507 | B2 * | 6/2010 | Nakano | B26B 19/141 | 30/43.4 |
| 9,555,551 | B2 * | 1/2017 | Campbell | B26B 19/143 | |
| 9,789,616 | B2 * | 10/2017 | Mimura | B26B 19/141 | |
| 9,873,204 | B2 * | 1/2018 | Zuider | B26B 19/143 | |
| 10,357,889 | B2 * | 7/2019 | Odagiri | B26B 19/141 | |
| 10,442,095 | B2 * | 10/2019 | Shimizu | B26B 19/145 | |
| 10,836,057 | B2 * | 11/2020 | Godlieb | B26B 19/141 | |
| 2006/0179660 | A1 | 8/2006 | Nakano | | |
| 2008/0028618 | A1 | 2/2008 | Okabe | | |
| 2010/0139099 | A1 | 6/2010 | Blaauw | | |
| 2013/0145627 | A1 * | 6/2013 | Murzynski | B26B 19/141 | 30/43.5 |
| 2016/0082607 | A1 * | 3/2016 | Shimizu | B26B 19/143 | 30/43.6 |
| 2018/0015621 | A1 | 1/2018 | Odagiri | | |
| 2020/0061857 | A1 * | 2/2020 | Silvius | B26B 19/143 | |
| 2020/0384660 | A1 * | 12/2020 | Odagiri | B26B 19/145 | |
| 2021/0252724 | A1 * | 8/2021 | Veenstra | B26B 19/143 | |

FOREIGN PATENT DOCUMENTS

| | | | | | |
|---|---|---|---|---|---|
| EP | 3398733 | | 11/2018 | | |
| EP | 3659759 | A1 * | 6/2020 | B26B 19/143 | |
| EP | 3711911 | A1 * | 9/2020 | B26B 19/143 | |
| WO | 2013/093718 | | 6/2013 | | |
| WO | 2014/147520 | | 9/2014 | | |
| WO | WO-2020109094 | A1 * | 6/2020 | B26B 19/141 | |

* cited by examiner

HAIR-CUTTING UNIT WITH CUTTER BLOCKING PREVENTION

CROSS REFERENCE TO RELATED APPLICATIONS

This application is the U.S. National Phase application under 35 U.S.C. § 371 of International Application No. PCT/EP2019/081861 filed Nov. 20, 2019, which claims the benefit of European Patent Application Number 18208986.2 filed Nov. 28, 2018. These applications are hereby incorporated by reference herein.

FIELD OF THE INVENTION

The invention relates to a hair-cutting unit for use in a shaving device, said hair-cutting unit comprising an external cutting member and an internal cutting member which is rotatable relative to the external cutting member in a rotational direction about an axis of rotation, wherein:

the internal cutting member comprises a plurality of cutting elements, each having a cutting edge with a respective main direction of extension in a radial direction relative to the axis of rotation;

the external cutting member comprises an annular wall portion having an outer surface facing away from the internal cutting member and a plurality of hair-entry openings which are mutually separated by hair-guiding elements, each hair-entry opening and each hair-guiding element having a respective main direction of extension in a radial direction relative to the axis of rotation, and each hair-guiding element having a counter-cutting edge for co-operation with the cutting edges of the internal cutting member during rotation of the internal cutting member in said rotational direction;

each cutting element has a top surface facing the hair-guiding elements and a front surface facing in the rotational direction, wherein said top surface and said front surface mutually connect at the cutting edge of the respective cutting element, and wherein, in a cross-section of the respective cutting element taken perpendicularly to the radial direction, a normal vector at the front surface is defined with a direction facing away from the cutting element;

each hair-guiding element has an inner surface facing the cutting elements and a side surface facing in a direction opposite to the rotational direction, wherein said inner surface and said side surface mutually connect at the counter-cutting edge of the respective hair-guiding element, and wherein, in a cross-section of the respective hair-guiding element taken perpendicularly to the radial direction, a normal vector at the side surface is defined with a direction facing away from the hair-guiding element;

during rotation of the internal cutting member in said rotational direction, seen in an axial direction relative to the axis of rotation, the cutting edges pass the counter-cutting edges, the cutting edges and the counter-cutting edges enclosing a shearing angle during said passing, and each said passing starting at a radial initial-passing position relative to the axis of rotation, said radial initial-passing position being defined as a radial position at which a respective cutting edge first meets a respective counter-cutting edge as compared to other radial positions along the respective cutting edge.

BACKGROUND OF THE INVENTION

Typically, for hair-cutting units of the type as initially identified above the thickness of the hair-guiding elements of the external cutting member is relatively small in order to provide an acceptable degree of closeness of the hair-cutting process. However, a disadvantage of the small thickness of the hair-guiding elements is that the hair-guiding elements may more easily deform under the influence of pressure exerted thereon by the skin, i.e. the hair-guiding elements may be pressed towards the rotating cutting elements of the internal cutting member. This may result in the cutting elements colliding with the depressed hair-guiding elements, which may result in damage of the cutting elements and the hair-guiding elements or even in blocking of the rotational motion of the internal cutting member.

SUMMARY OF THE INVENTION

It is an object of the invention to reduce the above-described damage of the cutting elements and the hair-guiding elements and to reduce the risk of the above-described blocking of the rotational motion of the internal cutting member, while at the same time still allowing for a relatively small thickness of the hair-guiding elements.

For that purpose the invention provides a hair-cutting unit according to the appended independent claim 1. Preferable embodiments of the invention are provided by the appended dependent claims.

Hence, the invention provides a hair-cutting unit of the type as initially identified above, wherein the hair-cutting unit further is characterized in that, in a cross-section at said radial initial-passing position and taken perpendicularly to the radial direction, only one of the internal cutting member and the external cutting member is provided with an abutment geometry according to which, at each position on an abutment segment, said normal vector has a non-zero axial component being parallel to the axis of rotation and being directed towards the other one of the internal cutting member and the external cutting member such that:

in case the internal cutting member is provided with said abutment geometry, said abutment segment is a segment of the front surface extending from the cutting edge until an end point of said segment of the front surface, said axial component being directed towards the outer surface of the annular wall portion of the external cutting member at each position on said abutment segment; and in case the external cutting member is provided with said abutment geometry, said abutment segment is a segment of the side surface extending from the counter-cutting edge until an end point of said segment of the side surface, said axial component being directed away from said outer surface at each position on said abutment segment.

Said radial initial-passing position indicates a radial position at which each of the mutually co-operating cutting edge of a cutting element and counter-cutting edge of a hair-guiding element has its own first mutually crossing portion during rotation of the internal cutting member. In other words, the present invention provides that the above-specified abutment geometry is applied at least at the radial position of said first mutually crossing portions of the co-operating cutting edge and counter-cutting edge. This means that, in case a hair-guiding element is depressed by a pressing skin rather far towards a rotating cutting element, the abutment geometry will be effective at least at the radial position of said first mutually crossing portions of the co-operating cutting edge and counter-cutting edge. So, in case when a rotating cutting element at that radial position collides onto a depressed hair-guiding element, a reaction force will occur on the cutting element in such manner that, thanks to the inclination direction of the front surface or side surface concerned relative to the axial direction, the cutting element and the depressed hair-guiding element are being pushed axially away from one another, so that the cutting element will pass the hair-guiding element without being blocked and without causing too much collision damage.

It is further noted that the provision of the abutment geometry on only one of the internal and external cutting members has the additional advantage that, at the location of the abutment geometry, a reasonable/good cutting performance is maintained.

In the light of the present invention, the terms "cutting edge" and "counter-cutting edge" are to be interpreted as an edge having a radius of curvature enabling hair cutting in co-operation with, respectively, a counter-cutting edge or a cutting edge. In particular, the radius of curvature of the cutting edge is equal to or smaller than 30 micrometers, more preferably equal to or smaller than 20 micrometers, and most preferably equal to or smaller than 15 micrometers In a preferable embodiment of the invention:

a first angle $\alpha 1$ between the axis of rotation and said normal vector at the front surface of the cutting element is defined in the acute angular range $0° \leq \alpha 1 \leq 90°$ as opposed to the obtuse angular range $90° \leq \alpha 1 \leq 180°$;

a second angle $\alpha 2$ between the axis of rotation and said normal vector at the side surface of the hair-guiding element is defined in the acute angular range $0° \leq \alpha 2 \leq 90°$ as opposed to the obtuse angular range $90° \leq \alpha 2 \leq 180°$;

in case the internal cutting member is provided with said abutment geometry, said first angle $\alpha 1$ between the axis of rotation and said normal vector at said abutment segment of the front surface of the cutting element is within the range $45° \leq \alpha 1 < 90°$, preferably $50° \leq \alpha 1 < 80°$; and in case the external cutting member is provided with said abutment geometry, said second angle $\alpha 2$ between the axis of rotation and said normal vector at said abutment segment of the side surface of the hair-guiding element is within the range $45° \leq \alpha 2 < 90°$, preferably $50° \leq \alpha 2 < 80°$.

Said ranges of the first angle $\alpha 1$ and of the second angle $\alpha 2$ appear to be particularly effective in reducing collision damage and risk of cutter blockage in case of depressed hair-guiding elements.

In a further preferable embodiment of the invention said abutment segment of, respectively, the front surface and the side surface is straight.

Depending on circumstances, such as the deformation properties of the hair-guiding elements, such a straight abutment segment may be particularly effective in reducing collision damage and risk of cutter blockage in case of depressed hair-guiding elements.

In further preferable embodiments of the invention said abutment segment of, respectively, the front surface and the side surface is convexly or concavely curved.

Depending on circumstances, such as the deformation properties of the hair-guiding elements, such a convexly or concavely curved abutment segment may be particularly effective in reducing collision damage and risk of cutter blockage in case of depressed hair-guiding elements.

In a further preferable embodiment of the invention said abutment segment of, respectively, the front surface and the side surface, in said cross-section at said radial initial-passing position and taken perpendicularly to the radial direction, extends in the axial direction over a distance $H \geq 1/(500*T)$, wherein T is a minimum thickness of the hair-guiding elements, and wherein H and T are expressed in mm.

Such an extension of said abutment segment over a distance $H \geq 1/(500*T)$ in the axial direction provides a smaller minimum required "height" H of the abutment segment for a thicker hair-guiding element. Such a smaller minimum required height H of the abutment segment suffices, since thicker hair-guiding elements have a smaller deformation.

In a further preferable embodiment of the invention said abutment segment of, respectively, the front surface and the side surface, in said cross-section at said radial initial-passing position and taken perpendicularly to the radial direction, extends in the axial direction over a distance H in a range between 10% and 80% of a minimum thickness of the hair-guiding elements.

Such an extension in the axial direction of said abutment segment appears to be particularly effective in preventing collision damage and cutter blockage in case of depressed hair-guiding elements having relatively small minimum thickness.

A further preferable embodiment of the invention has the further features that, in case the external cutting member is provided with said abutment geometry, said side surface, in said cross-section at said radial initial-passing position and taken perpendicularly to the radial direction, has a further segment extending from the end point of said abutment segment of the side surface in a direction towards the outer surface of the annular wall portion of the external cutting member, wherein at each position on said further segment the normal vector to the side surface has no axial component or a non-zero axial component which is directed towards said outer surface.

The last-mentioned further features allow for particularly effective designs of the external cutting member in terms of hair-guiding performance.

A further preferable embodiment of the invention has the further features that, in case the internal cutting member is provided with said abutment geometry, said front surface, in said cross-section at said radial initial-passing position and taken perpendicularly to the radial direction, has a further segment extending from the end point of said abutment segment of the front surface in a direction away from the outer surface of the annular wall portion of the external cutting member, wherein at each position on said further segment the normal vector to the front surface has a non-zero axial component which is directed away from said outer surface.

The last-mentioned further features allow for particularly effective designs of the internal cutting member in terms of hair-cutting performance.

In a further preferable embodiment of the invention said abutment geometry is provided in any cross-section, taken perpendicularly to the radial direction, within a range of radial positions relative to the axis of rotation including said radial initial-passing position.

Providing said abutment geometry in said range of radial positions, instead of only at said radial initial-passing position, results into an improved radial distribution of axially pushing-away forces between a respective cutting element and a respective depressed hair-guiding element, which further reduces collision damage and risk of cutter blockage in case of depressed hair-guiding elements.

In a further preferable embodiment of the invention said abutment geometry is provided only within said range of radial positions.

Not providing said abutment geometry outside said range of radial positions allows for optimizing, outside said range of radial positions, the shapes of the front surfaces of the cutting elements and of the side surfaces of the hair-guiding elements with respect to hair-cutting performance.

In a further preferable embodiment of the invention the cutting edges extend from a radially inward cutting edge tip at a first radial position relative to the axis of rotation until a radially outward cutting edge tip at a second radial position relative to the axis of rotation, and wherein said range of radial positions includes said first radial position.

This results into the above-mentioned improved radial distribution of axially pushing-away forces between a respective cutting element and a respective depressed hair-guiding element in cases where the first mutually crossing portions of the co-operating cutting edge and counter-cutting edge are at or close to said radially inward cutting edge tip.

In a further preferable embodiment of the invention the cutting edges extend from a radially inward cutting edge tip at a first radial position relative to the axis of rotation until a radially outward cutting edge tip at a second radial position relative to the axis of rotation, wherein said range of radial positions includes said second radial position.

This results into the above-mentioned improved radial distribution of axially pushing-away forces between a respective cutting element and a respective depressed hair-guiding element in cases where the first mutually crossing portions of the co-operating cutting edge and counter-cutting edge are at or close to said radially outward cutting edge tip.

In a further preferable embodiment of the invention the cutting edges extend from a radially inward cutting edge tip at a first radial position relative to the axis of rotation until a radially outward cutting edge tip at a second radial position relative to the axis of rotation, wherein said range of radial positions extends from a third radial position relative to the axis of rotation to a fourth radial position relative to the axis of rotation, and wherein a radial distance between the third and fourth radial positions is between 5% and 50% of a radial distance between the first and second radial positions, preferably between 5% and 25% of the radial distance between the first and second radial positions.

Such a radial distance between the third and fourth radial positions appears to be particularly effective in preventing collision damage and cutter blockage in case of depressed hair-guiding elements having relatively small minimum thickness.

In a further preferable embodiment of the invention the cutting edges extend from a radially inward cutting edge tip at a first radial position relative to the axis of rotation until a radially outward cutting edge tip at a second radial position relative to the axis of rotation, wherein said range of radial positions includes said first and second radial positions.

This results into a further improved radial distribution of axially pushing-away forces between a respective cutting element and a respective depressed hair-guiding element, which further reduces collision damage and risk of cutter blockage in case of depressed hair-guiding elements.

The invention may further be embodied in a shaving unit for use in a shaving device, said shaving unit comprising a supporting member and at least two hair-cutting units according to any one of the above-mentioned embodiments of the invention.

The invention may further be embodied in a shaving device comprising a shaving unit according to the last-mentioned embodiment of the invention and a main body accommodating a motor 33 and a drive system 34, wherein the shaving unit is coupled to the main body such that the internal cutting members of the hair-cutting units are rotatable by means of the motor 33 via the drive system 34.

BRIEF DESCRIPTION OF THE DRAWINGS

The above-mentioned aspects and other aspects of the invention will be apparent from and elucidated with reference to the embodiments described hereinafter by way of non-limiting examples only and with reference to the schematic figures in the enclosed drawing.

FIG. 4A illustrates a first embodiment of the invention, wherein the external cutting member is provided with the abutment geometry in a cross-section according to the line A-A in FIG. 3, i.e. at the radial initial-passing position and taken perpendicularly to the radial direction, wherein FIG. 4A shows in said cross-section a hair-guiding element of the external cutting member, as well as a normal vector at the side surface of the hair-guiding element, said normal vector facing away from the hair-guiding element.

FIG. 4B again shows the situation and cross-section of FIG. 4A related to the first embodiment of the invention, however, this time together with a portion of a rotating cutting element of the internal cutting member, and this time in a condition in which the hair-guiding element, under the influence of pressure exerted thereon by a skin, is slightly depressed towards the rotating cutting element, wherein FIG. 4B shows the situation just prior to the moment the cutting edge of the rotating cutting element will collide with the abutment geometry of the depressed hair-guiding element.

FIG. 5A illustrates a second embodiment of the invention, wherein the internal cutting member is provided with the abutment geometry in said cross-section according to the line A-A in FIG. 3, wherein FIG. 5A shows in said cross-section a rotating cutting element of the internal cutting member, as well as a normal vector at the front surface of the cutting element, said normal vector facing away from the cutting element.

FIG. 5B again shows the situation and cross-section of FIG. 5A related to the second embodiment of the invention, however, this time together with a portion of a hair-guiding element of the external cutting member in a condition in which the hair-guiding element, under the influence of pressure exerted thereon by a skin, is slightly depressed towards the rotating cutting element, wherein FIG. 5B shows the situation just prior to the moment the abutment geometry of the rotating cutting element will collide with the counter-cutting edge of the depressed hair-guiding element.

The reference signs used in the above-mentioned FIGS. 1-8B are referring to the above-mentioned parts and aspects of the invention, as well as to related parts and aspects, in the following manner.

Figure 1:
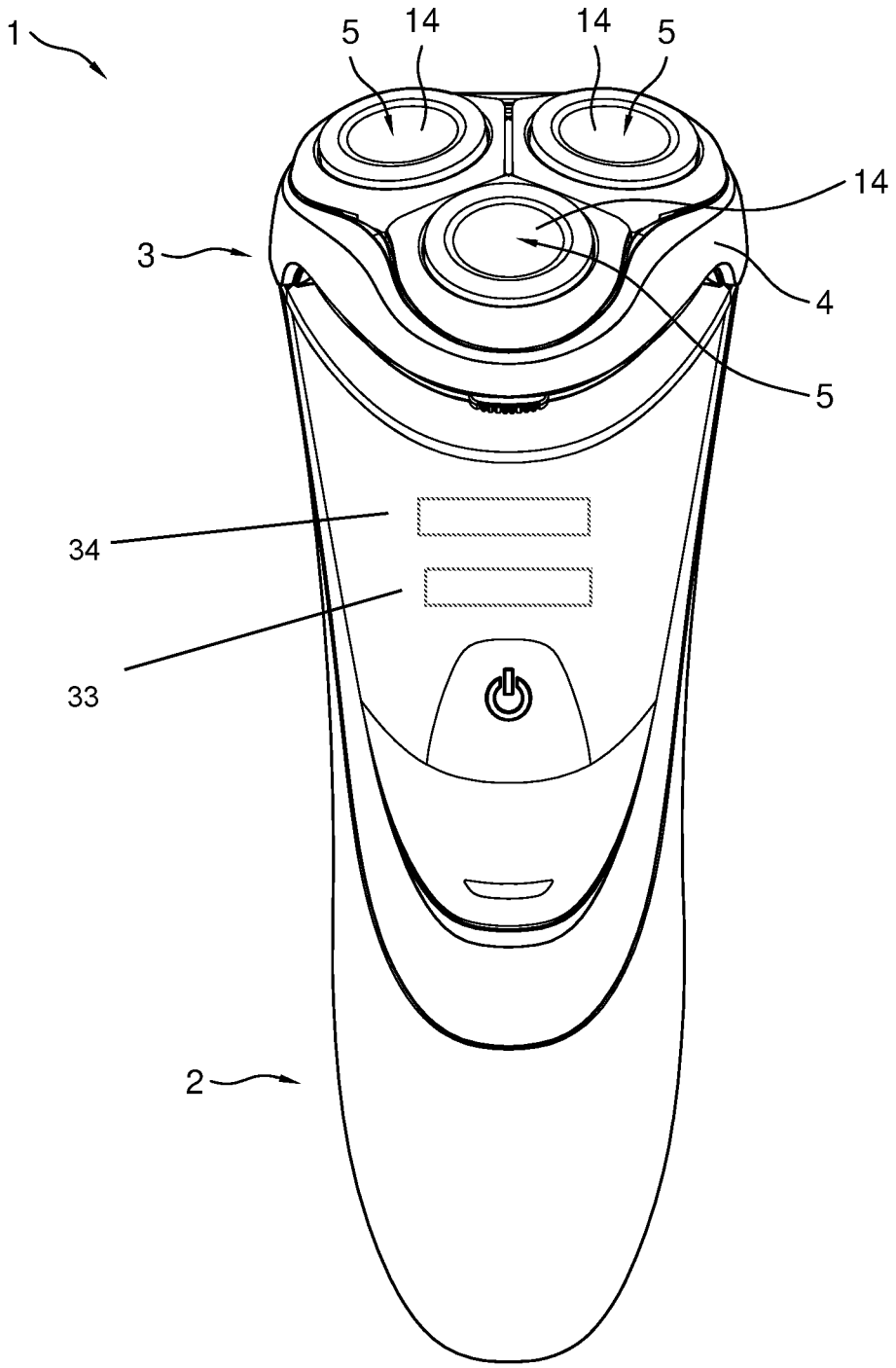
FIG. 1 shows, in a perspective view, an example of a shaving device according to the invention.

1 shaving device
2 main body
3 shaving unit
4 supporting member
5 hair-cutting unit
6 external cutting member
7 internal cutting member
8 rotational direction
9 axis of rotation
10 cutting element
11 cutting edge
12 annular wall portion
14 outer surface
15 hair-entry opening
16 hair-guiding element
17 counter-cutting edge
18 top surface
19 front surface
20 normal vector at the front surface
21 inner surface
22 side surface
23 normal vector at the side surface
24 shearing angle
25 abutment segment of the front surface
26 end point of the abutment segment of the front surface
27 abutment segment of the side surface
28 end point of the abutment segment of the side surface
29 further segment of the side surface
30 further segment of the front surface
31 radially inward cutting edge tip
32 radially outward cutting edge tip
$\alpha$1 first angle
$\alpha$2 second angle
R radial direction
R0 radial initial-passing position
R1 first radial position
R2 second radial position
R3 third radial position
R4 fourth radial position In FIGS. 1-8B sometimes the same reference signs have been used for parts and aspects which are alike for the different embodiments shown in these figures.

DETAILED DESCRIPTION OF THE EMBODIMENTS

Based on the above introductory description, including the brief description of the drawing figures, and based on the above-explained reference signs used in the drawing, the shown examples of FIGS. 1-8B are for the greatest part readily self-explanatory. The following extra explanations are given.

Figure 2:
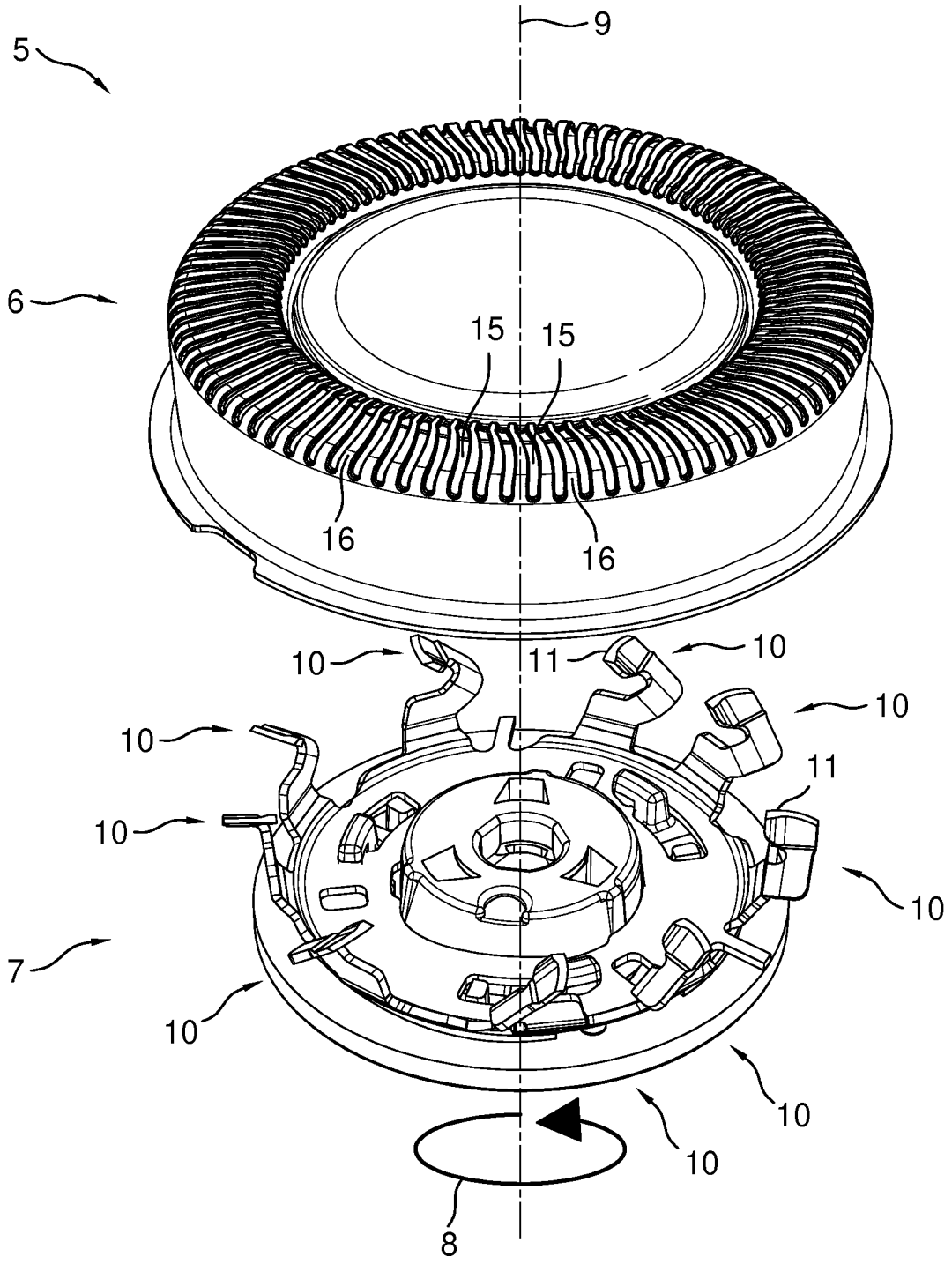
FIG. 2 separately shows one of the three identical hair-cutting units of the shaving device of FIG. 1, wherein the internal cutting member and the external cutting member of the shown hair-cutting unit are shown in an exploded perspective view.

FIG. 2 shows that the internal cutting member 7 of a hair-cutting unit 5 of the shaving device 1 of FIG. 1 has a plurality of cutting elements 10, which are equally spaced in circumferential direction around the axis of rotation 9.

Figure 3:
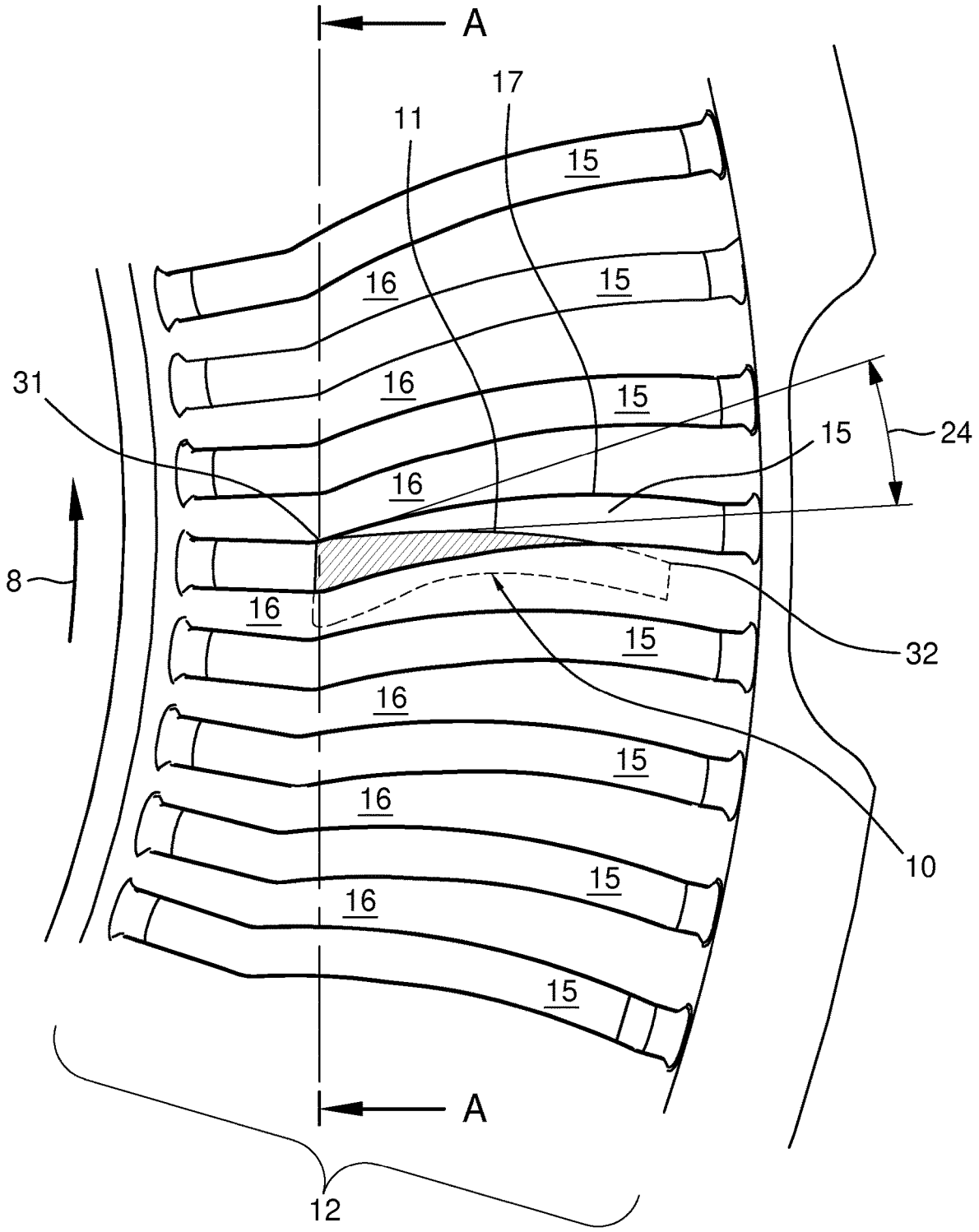
FIG. 3 is a more detailed upper view on a portion of the hair-cutting unit of FIG. 2, wherein said upper view is taken on the outer surface of the external cutting member in a direction parallel to the axis of rotation of the hair-cutting unit.

FIG. 3 shows one such cutting element 10 with its cutting edge 11 having the radially inward cutting edge tip 31 and the radially outward cutting edge tip 32. In the shown example, said radially inward cutting edge tip 31 is located at the above-mentioned radial initial-passing position. This means that, during rotation of the internal cutting member 7 in the rotational direction 8, the radially inward cutting edge tip 31 of the cutting edge 11 first meets a respective counter-cutting edge 17 as compared to other parts of the cutting edge 11. In fact FIG. 3 shows the moment when the cutting edge 11 and the respective counter-cutting edge 17 indeed first meet in that sense at the radial initial-passing position. FIG. 3 further shows the shearing angle 24 enclosed by the cutting edge 11 and the counter-cutting edge 17 at the radial initial-passing position where the radially inward cutting edge tip 31 is located.

Figure 4A:
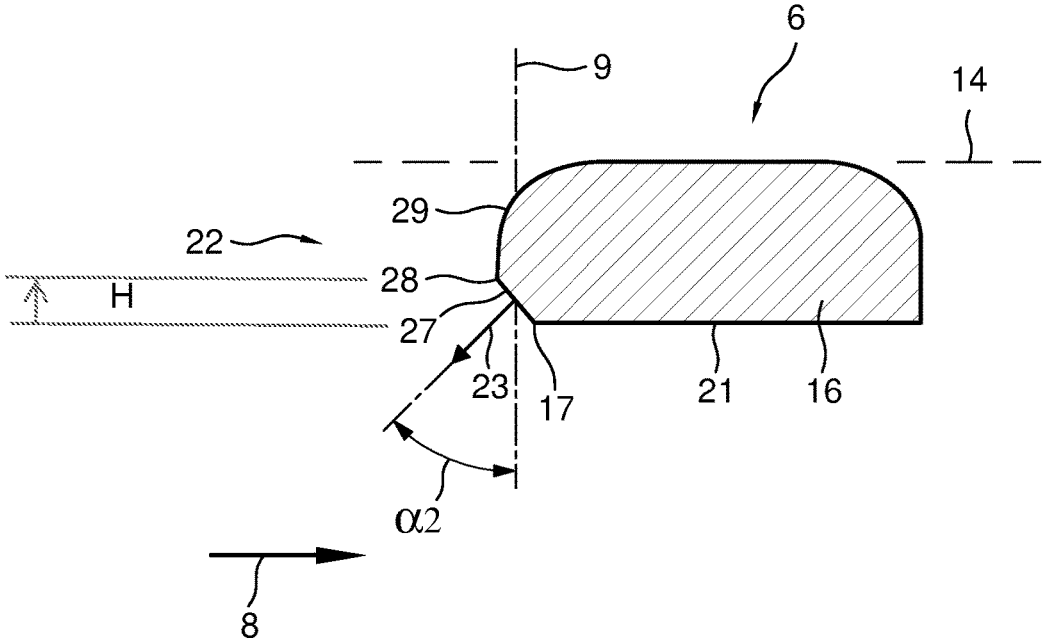

FIG. 4A particularly serves to illustrate, according to said first embodiment of the invention, the configuration of the abutment geometry of the external cutting member 6 at the radial initial-passing position. FIG. 4A shows the inner surface 21 and the side surface 22 of the hair-guiding element 16 of the external cutting member 6. It is seen that the side surface 22 comprises the abutment segment 27 which is extending from the counter-cutting edge 17 until the end point 28. In the shown example the abutment segment 27 is straight. As mentioned, in alternative embodiments the abutment segment 27 could also be convexly or concavely curved. It is further seen that the shown normal vector 23 at the abutment segment 27 is, according to its definition, facing away from the hair-guiding element 16. FIG. 4A further shows the above-mentioned second angle $\alpha 2$ between the axis of rotation 9 and the normal vector 23, said second angle $\alpha 2$ being defined in the acute angular range $0° \leq \alpha 2 \leq 90°$ between the axis and the vector. From FIG. 4A it follows that the shown normal vector 23 has a non-zero axial component (i.e. parallel to the axis of rotation 9), which is directed away from the shown outer surface 14 of the annular wall portion 12 of the external cutting member 6.

It is noted that in the shown example of FIG. 4A the side surface 22 has the above-mentioned further segment 29 extending from the end point 28 of the abutment segment 27 in a direction towards the outer surface 14, wherein at each position on said further segment 29 the normal vector to the side surface 22 has no axial component or a non-zero axial component which is directed towards said outer surface 14.

Reference is now made to FIG. 4B, which again shows the situation and cross-section of FIG. 4A related to the first embodiment of the invention, however, this time together with a portion of the rotating cutting element 10 of the internal cutting member 7, and this time in a condition in which the hair-guiding element 16, under the influence of pressure exerted thereon by a skin, is slightly depressed towards the rotating cutting element 7, wherein FIG. 4B shows the situation just prior to the moment the cutting edge 11 of the rotating cutting element 10 will collide with the abutment segment 27 of the side surface 22 of the depressed hair-guiding element 16.

Figure 4B:
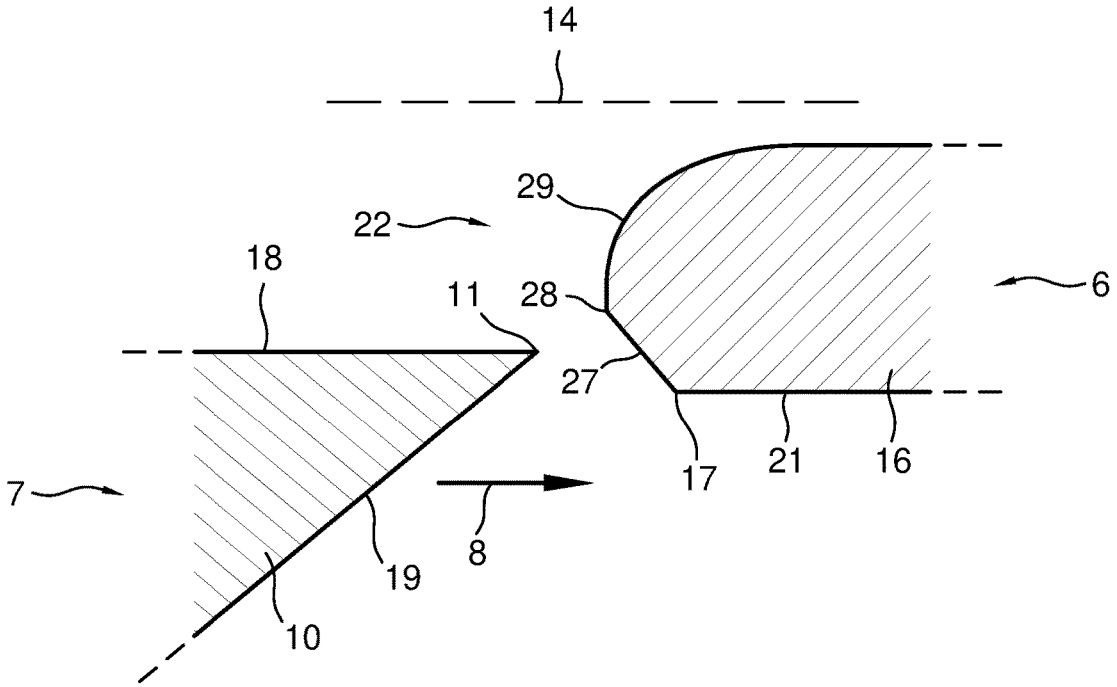

From FIG. 4B it will be readily appreciated that, when the cutting edge 11 at the radial initial-passing position of FIGS. 4A-4B thus collides with the abutment segment 27, a reaction force will occur on the cutting element 10 in such manner that, thanks to the inclination direction of the abutment segment 27 of the side surface 22 relative to the axis of rotation 9 (cf. FIG. 4A), the cutting element 10 and the depressed hair-guiding element 16 are being pushed axially away from one another, so that the cutting element 10 will pass the hair-guiding element 16 in the rotational direction 8 without being blocked and without causing too much collision damage.

It is noted that the configuration shown in FIG. 4B at the same time allows for a very good performance of hair-cutting between the sharp cutting edge 11 of the cutting element 10 and the abutment segment 27 of the side surface 22 of the depressed hair-guiding element 16.

Figure 5A:
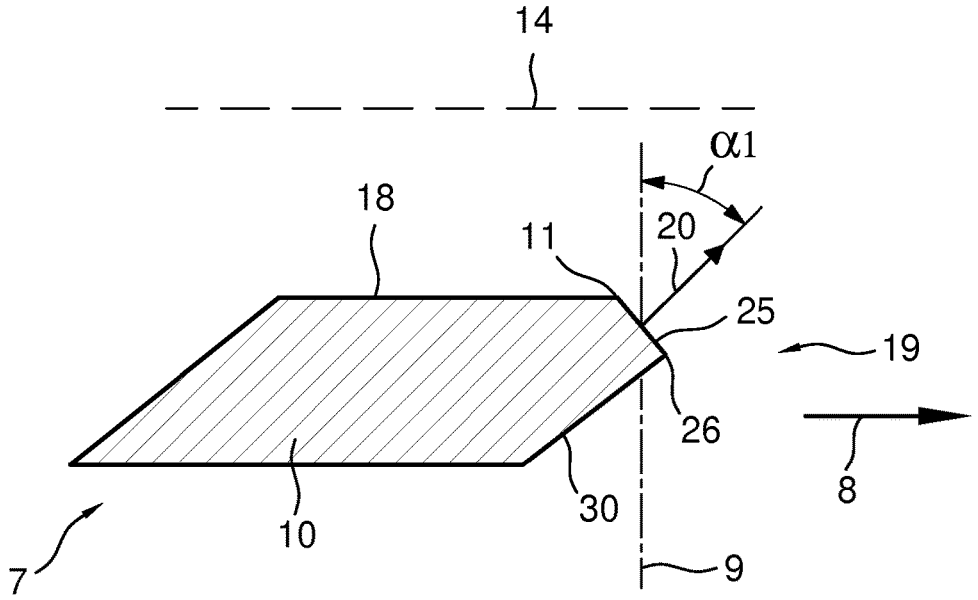

FIG. 5A particularly serves to illustrate, according to said second embodiment of the invention, the configuration of the abutment geometry of the internal cutting member 7 at the radial initial-passing position. FIG. 5A shows the top surface 18 and the front surface 19 of the cutting element 10 of the internal cutting member 7. It is seen that the front surface 19 comprises the abutment segment 25 which is extending from the cutting edge 11 until the end point 26. In the shown example the abutment segment 25 is straight. As mentioned, in alternative embodiments the abutment segment 25 could also be convexly or concavely curved. It is further seen that the shown normal vector 20 at the abutment segment 25 is, according to its definition, facing away from the cutting element 10. FIG. 5A further shows the above-mentioned first angle $\alpha 1$ between the axis of rotation 9 and the normal vector 20, said first angle $\alpha 1$ being defined in the acute angular range $0° \leq \alpha 2 \leq 90°$ between the axis and the vector. From FIG. 5A it follows that the shown normal vector 20 has a non-zero axial component (i.e. parallel to the axis of rotation 9), which is directed towards the shown outer surface 14 of the annular wall portion 12 of the external cutting member 6.

It is noted that in the shown example of FIG. 5A the front surface 19 has the above-mentioned further segment 30 extending from the end point 26 of the abutment segment 25 in a direction away from the outer surface 14, wherein at each position on said further segment 30 the normal vector to the front surface 19 has a non-zero axial component which is directed away from said outer surface 14.

Reference is now made to FIG. 5B, which again shows the situation and cross-section of FIG. 5A related to the second embodiment of the invention, however, this time together with a portion of the hair-guiding element 16 of the external cutting member 6, and this time in a condition in which the hair-guiding element 16, under the influence of pressure exerted thereon by a skin, is slightly depressed towards the rotating cutting element 7, wherein FIG. 5B shows the situation just prior to the moment the abutment segment 25 of the front surface 19 of the rotating cutting element 10 will collide with the counter-cutting edge 17 of the depressed hair-guiding element 16.

Figure 5B:
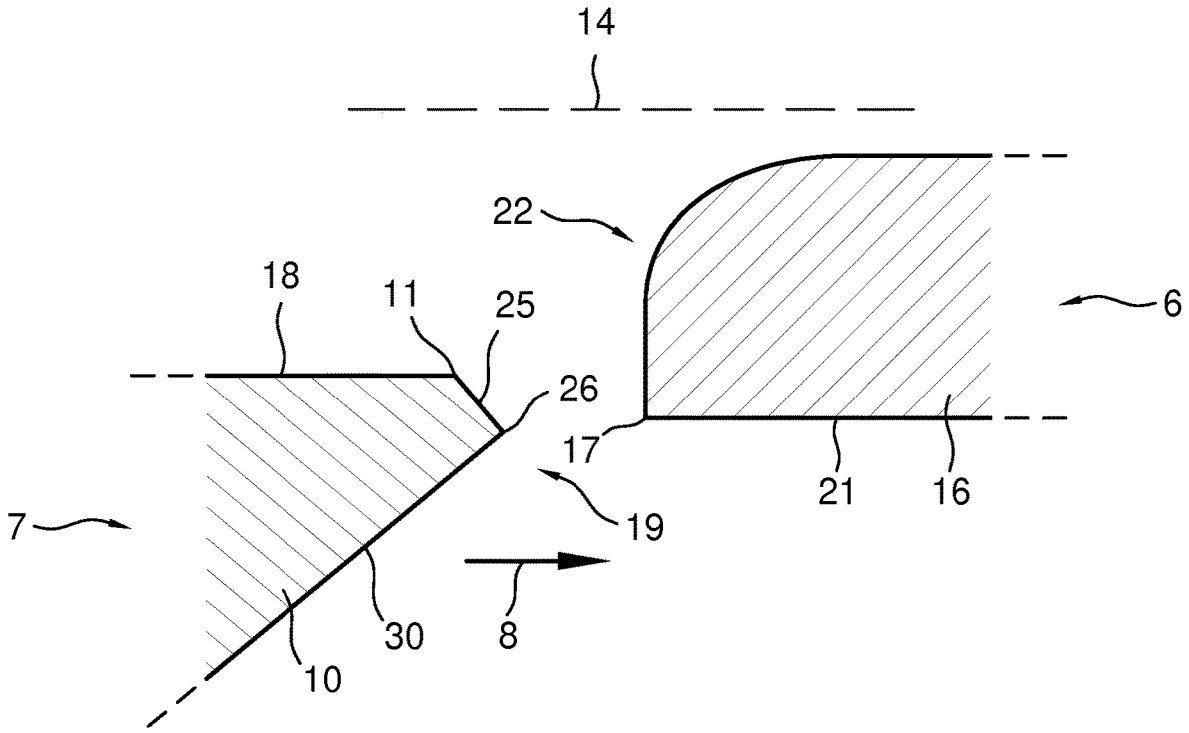

From FIG. 5B it will be readily appreciated that, when the abutment segment 25 at the radial initial-passing position of FIGS. 5A-5B thus collides with the counter-cutting edge 17, a reaction force will occur on the cutting element 10 in such manner that, thanks to the inclination direction of the abutment segment 25 of the front surface 19 relative to the axis of rotation 9 (cf. FIG. 5A), the cutting element 10 and the depressed hair-guiding element 16 are being pushed axially away from one another, so that the cutting element 10 will pass the hair-guiding element 16 in the rotational direction 8 without being blocked and without causing too much collision damage.

It is noted that the configuration shown in FIG. 5B at the same time allows for a very good performance of hair-cutting between the abutment segment 25 of the front surface 19 of the cutting element 10 and the sharp counter-cutting edge 17 of the depressed hair-guiding element 16.

Reference is now made to the further embodiments of the invention as shown in FIGS. 6A-8B.

These further embodiments of FIGS. 6A-8B are examples of all the above-mentioned further preferable embodiments of the invention, having the further features that the abutment geometry is provided in any cross-section, taken perpendicularly to the radial direction, within a range of radial positions relative to the axis of rotation including said radial initial-passing position R0.

It is seen that all embodiments of FIGS. 6A-8B have in common that the planforms of their respective hair-guiding elements 16 are the same. All embodiments of FIGS. 6A-8B further have in common that the cutting edge 11 is extending from the radially inward cutting edge tip 31 at the first radial position R1 until the radially outward cutting edge tip 32 at the second radial position R2.

Figure 6A:
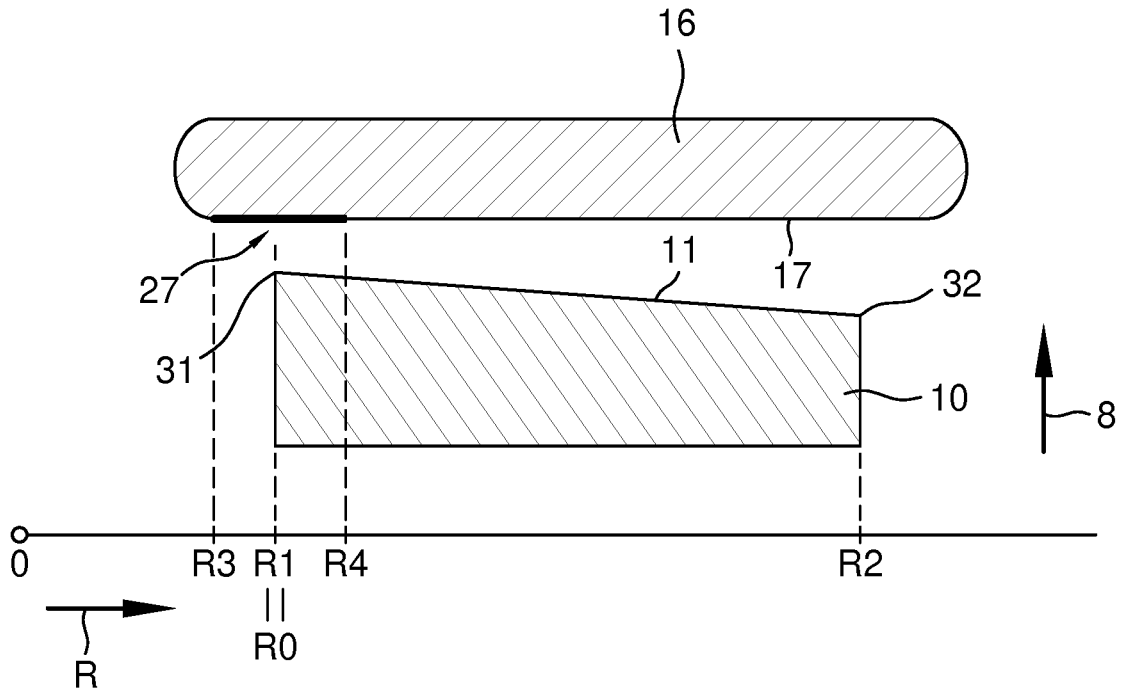
FIG. 6A illustrates a further embodiment of the invention in an upper view similar to that of FIG. 3.
Figure 6B:
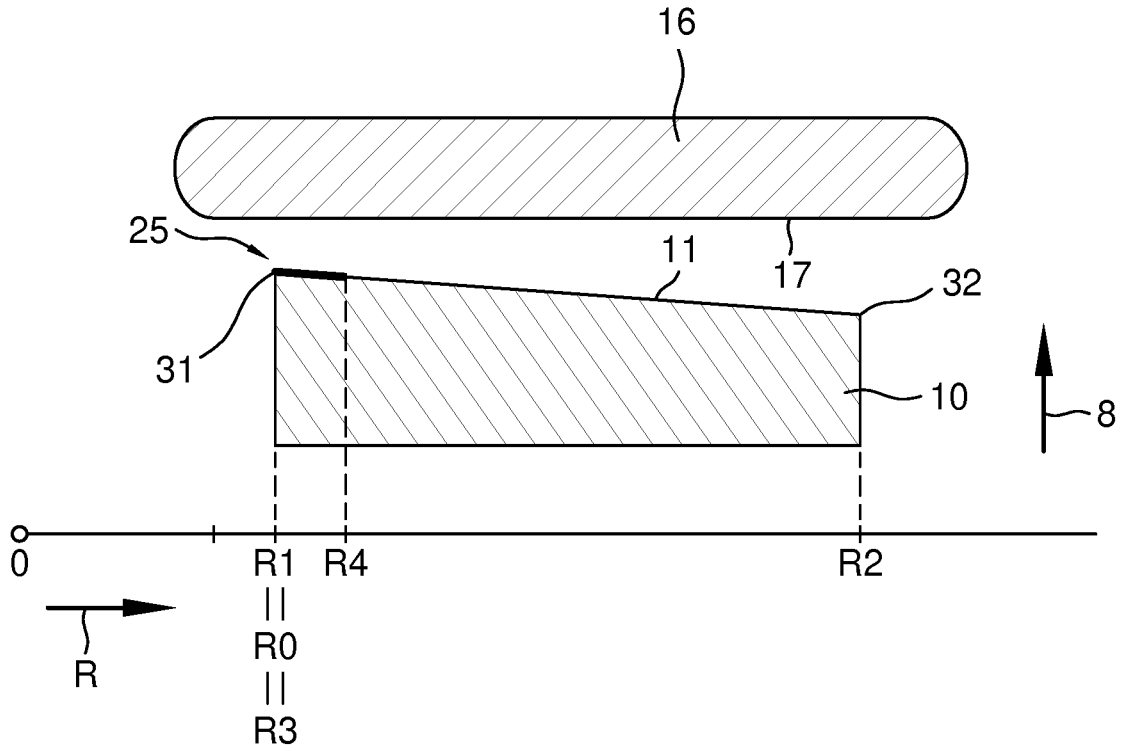
FIG. 6B illustrates a yet further embodiment of the invention in an upper view similar to that of FIG. 3.

The embodiments of FIGS. 6A and 6B have in common that the relative orientation between the cutting edge 11 and the counter-cutting edge 17 is the same. Also, the embodiments of FIGS. 7A and 7B have in common that the relative orientation between the cutting edge 11 and the counter-cutting edge 17 is the same. However, as compared to the embodiments of FIGS. 6A and 6B, the embodiments of FIGS. 7A and 7B have a differently shaped cutting edge 11, resulting in a different distribution of the shearing angle along the radial direction R, and resulting in a different radial initial-passing position R0. Also, the embodiments of FIGS. 8A and 8B have in common that the relative orientation between the cutting edge 11 and the counter-cutting edge 17 is the same. However, as compared to the embodiments of FIGS. 6A and 6B, and as also compared to the embodiments of FIGS. 7A and 7B, the embodiments of FIGS. 8A and 8B have a further differently shaped cutting edge 11, resulting in a further different distribution of the shearing angle along the radial direction R, and resulting in a further different radial initial-passing position R0.

Figure 7A:
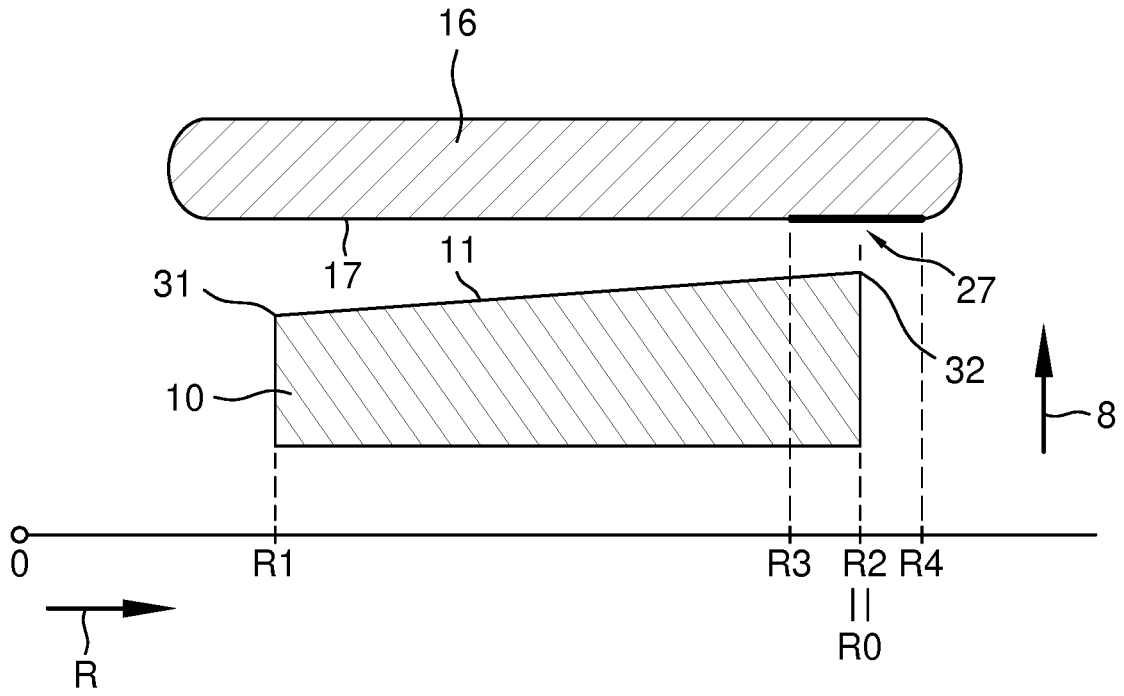
FIG. 7A illustrates a yet further embodiment of the invention in an upper view similar to that of FIG. 3.
Figure 7B:
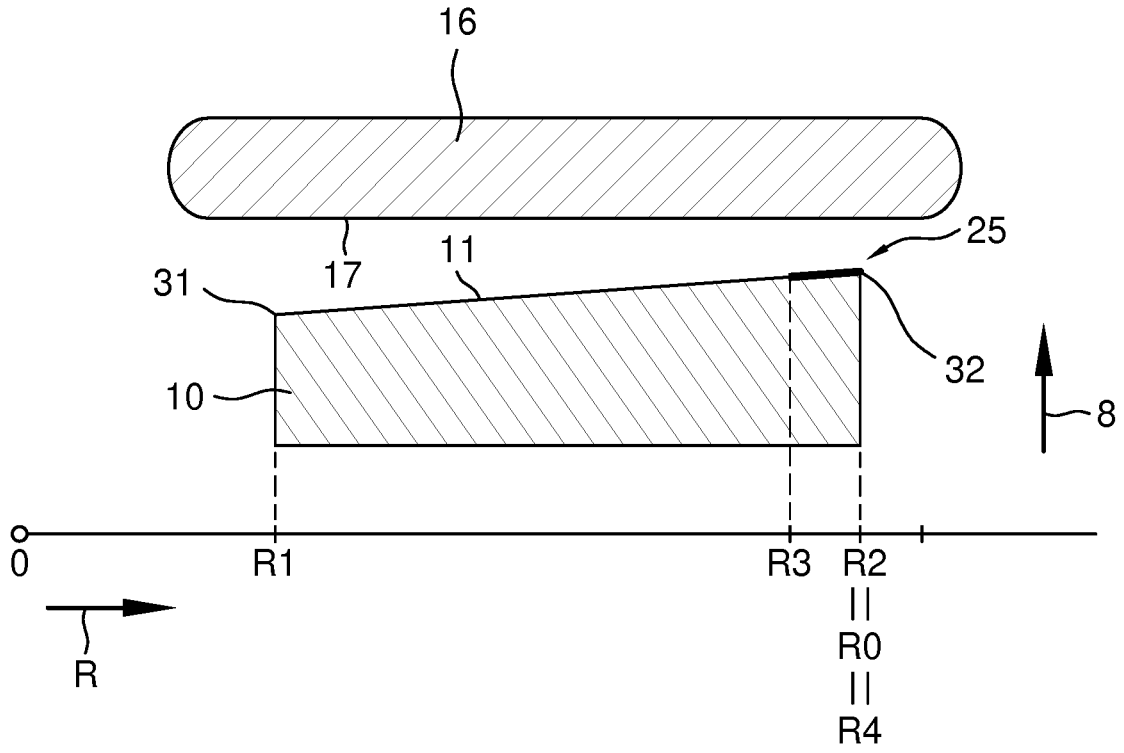
FIG. 7B illustrates a yet further embodiment of the invention in an upper view similar to that of FIG. 3.
Figure 8A:
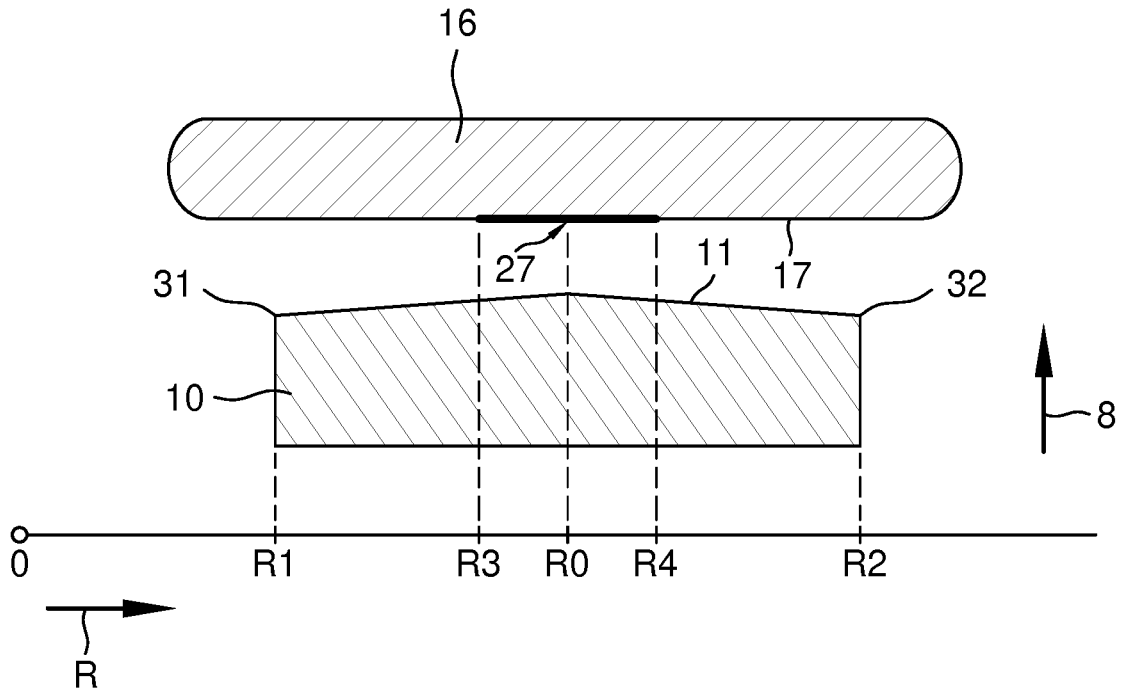
FIG. 8A illustrates a yet further embodiment of the invention in an upper view similar to that of FIG. 3.
Figure 8B:
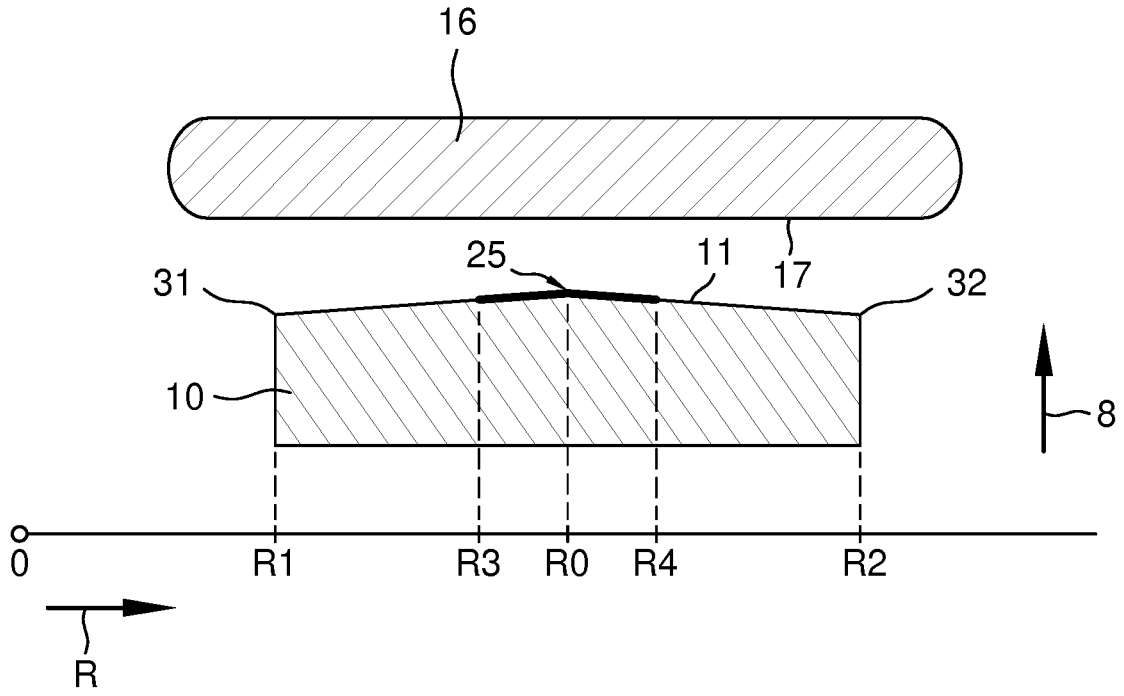
FIG. 8B illustrates a yet further embodiment of the invention in an upper view similar to that of FIG. 3.

The embodiments of FIGS. 6A, 7A, 8A have in common that they are examples of the case where the external cutting member, in case the shown hair-guiding element 16 thereof, is provided with the abutment geometry. See in FIGS. 6A, 7A, 8A for example the reference numerals 27, which each time at the radial initial-passing position R0 are indicating the location of the abutment segment 27 (see FIG. 4A) of the side surface 22 of the hair-guiding element 16. The embodiments of FIGS. 6B, 7B, 8B have in common that they are examples of the case where the internal cutting member, in case the shown cutting element 10 thereof, is provided with the abutment geometry. See in FIGS. 6B, 7B, 8B for example the reference numerals 25, which each time at the radial initial-passing position R0 are indicating the location of the abutment segment 25 (see FIG. 5A) of the front surface 19 of the cutting element 10. More specifically, in all embodiments of FIGS. 6A-8B the abutment geometry is provided in any cross-section, taken perpendicularly to the radial direction, within a radial range between R3 and R4 as indicated in the respective figures. It is seen that, in all embodiments of FIGS. 6A-8B, said radial range between R3 and R4 includes the respective radial initial-passing position R0.

While the invention has been described and illustrated in detail in the foregoing description and in the drawing figures, such description and illustration are to be considered exemplary and/or illustrative and not restrictive; the invention is not limited to the disclosed embodiments.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfil the functions of several items recited in the claims. For the purpose of clarity and a concise description, features are disclosed herein as part of the same or separate embodiments, however, it will be appreciated that the scope of the invention may include embodiments having combinations of all or some of the features disclosed. The mere fact that certain measures are recited in mutually different dependent claims does not indicate that a combination of these measures can not be used to advantage. Any reference signs in the claims should not be construed as limiting the scope.

The invention claimed is:

1. A hair-cutting unit for use in a shaving device, said hair-cutting unit comprising:

an external cutting member comprising hair-guiding elements;

an internal cutting member, which is rotatable relative to the external cutting member in a rotational direction about an axis of rotation, to define an axial plane of rotation;

wherein the internal cutting member comprises a plurality of cutting elements, each cutting element being spaced in a circumferential direction, each having a cutting edge with a respective main direction of extension in a radial direction in the axial plane of rotation;

wherein each cutting element comprises a front surface and an outer surface, the outer surface facing towards the hair-guiding elements of the external cutting member respectively, and the front surface facing in the rotational direction in the plane of rotation, wherein an intersection of the outer surface and said front surface defines a cutting edge of the plurality of cutting elements, wherein the external cutting member comprises an annular wall portion having an outer shaving surface for contacting skin of a user, the outer shaving surface facing away from the internal cutting member, the hair-guiding elements which are mutually separated by hair-entry openings, each hair-entry opening and each hair-guiding element being spaced in the circumferential direction and extending substantially radially outward relative to the axis of rotation in the plane of rotation, and each hair-guiding element having a counter-cutting edge for co-operation with the cutting edges of the internal cutting member during the rotation of the internal cutting member in said rotational direction;

wherein each hair-guiding element of the external cutting member has an inner surface facing the cutting elements of the internal cutting member and a side surface facing in a direction opposite to the rotational direction in the plane of rotation, wherein said inner surface and said side surface intersect to define the counter-cutting edge of the hair-guiding elements;

wherein said side surface of said external cutting member further comprises an abutment segment defining a segment of the side surface extending from the counter-cutting edge until an end point of said abutment segment of the side surface;

wherein during the rotation of the internal cutting member in said rotational direction, seen in an axial direction in the plane of rotation relative to the axis of rotation, as the cutting edges of the internal cutting members pass the the counter-cutting edges of the external cutting members a shearing angle is defined between respective ones of the cutting edges at each of said passings, starting at a radial initial-passing position relative to the axis of rotation, said radial initial-passing position being defined as a radial position at which said cutting edge first meets said counter-cutting edge during each passing;

wherein in a cross-section of said hair guiding element, at said radial initial-passing position and taken perpendicularly to the plane of rotation, the side surface of the hair-guiding element of the external cutting member is provided with an abutment geometry at each position on said abutment segment, wherein a normal vector extends in a direction normal to the abutment segment, said normal vector having a non-zero axial component, parallel to the axis of rotation, which is directed away from the outer surface of the annular wall portion of the external cutting member.

2. The hair-cutting unit as claimed in claim 1, wherein said abutment segment of the side surface is straight.

3. The hair-cutting unit as claimed in claim 1, wherein said side surface, in said cross-section at said radial initial-passing position and taken perpendicularly to the radial direction has a further segment extending from the end point of said abutment segment of the side surface in a direction towards the outer surface of the annular wall portion of the external cutting member, wherein at each position on said further segment, said normal vector of said abutment segment has no axial component or a non-zero axial component which is directed towards said outer surface.

4. The hair-cutting unit as claimed in claim 1, wherein:

an angle $\alpha 2$ between the axis of rotation and said normal vector at said abutment segment of the side surface of the hair-guiding element is within the range $45° \leq \alpha 2 < 90°$.

5. The hair-cutting unit as claimed in claim 4, wherein said angle $\alpha 2$ is within the range $50° \leq \alpha 2 < 80°$.

6. The hair-cutting unit as claimed in claim 1, wherein said abutment segment of the side surface, in said cross-section at said radial initial-passing position and taken perpendicularly to the radial direction, extends in the axial direction over a distance $H \geq 1/(500*T)$, wherein T is a minimum thickness of the hair-guiding elements.

7. The hair-cutting unit as claimed in claim 1, wherein said abutment segment of side surface, in said cross-section at said radial initial-passing position and taken perpendicularly to the radial direction, extends in the axial direction over a distance H in a range between 10% and 80% of a minimum thickness of the hair-guiding elements.

8. The shaving unit for use in a shaving device, said shaving unit comprising a supporting member and at least two hair-cutting units according to claim 1 on the supporting member.

9. The shaving device comprising a shaving unit according to claim 8 and a main body accommodating a motor and a drive system, wherein the shaving unit is coupled to the main body such that the internal cutting members of the hair-cutting units are rotatable by means of the motor via the drive system.

* * * * *